United States Patent [19]

Breunig

[11] 4,337,150

[45] Jun. 29, 1982

[54] FIBER FRACTIONATING DEVICE

[75] Inventor: Anton Breunig, Anhausen, Fed. Rep. of Germany

[73] Assignee: Haindl Papier GmbH, Augsburg, Fed. Rep. of Germany

[21] Appl. No.: 185,909

[22] PCT Filed: Jan. 16, 1979

[86] PCT No.: PCT/DE79/00004

§ 371 Date: Sep. 17, 1979

§ 102(e) Date: Sep. 17, 1979

[87] PCT Pub. No.: WO79/00530

PCT Pub. Date: Aug. 9, 1979

[30] Foreign Application Priority Data

Jan. 19, 1978 [DE] Fed. Rep. of Germany ..... 2802207

[51] Int. Cl.[3] ..... D21F 1/00; B07B 1/00

[52] U.S. Cl. ..... 209/237; 209/250; 209/273

[58] Field of Search ..... 73/63, 432 PS; 209/237, 209/250, 273, 282; 162/55, 49, 50

[56] References Cited

U.S. PATENT DOCUMENTS

| | | | |
|---|---|---|---|
| 2,734,631 | 2/1956 | Kobliska | 209/237 |
| 2,988,223 | 6/1961 | Janson | 209/250 X |
| 3,789,978 | 2/1974 | Janson | 209/250 X |
| 3,827,567 | 8/1974 | Rundqvist | 209/250 X |

FOREIGN PATENT DOCUMENTS

| | | | |
|---|---|---|---|
| 846512 | 8/1952 | Fed. Rep. of Germany . | |
| 849798 | 9/1952 | Fed. Rep. of Germany . | |
| 1347207 | 11/1963 | France | 162/55 |
| 1449646 | 8/1966 | France . | |
| 1458561 | 11/1966 | France . | |

OTHER PUBLICATIONS

"Clark Pulp Classifier", Catalog No. 218-1.

"Fiber Fractionation of Mechanical Pulp in the McNett Apparatus", Scan Test M6:69, "Svensk Papperstidning" 72, (1969), pp. 312–314.

"Merkblatt VI/1/66", "DAS Papier" 20, (1966), pp. 256–265.

*Primary Examiner*—Ralph J. Hill

*Attorney, Agent, or Firm*—McDougall, Hersh & Scott

[57] ABSTRACT

A device for fiber fractionation to analyze for coarse particles or chips in which fractionation takes place by washing a sample of the fiber material on a horizontally disposed slotted plate submerged in water, a central bundle-type nozzle which extends from above into the water above the slotted plate, the jets of which are directed downwardly, preferably angularly, against the slotted plate, and means for collecting the material passing through the slotted plate.

11 Claims, 3 Drawing Figures

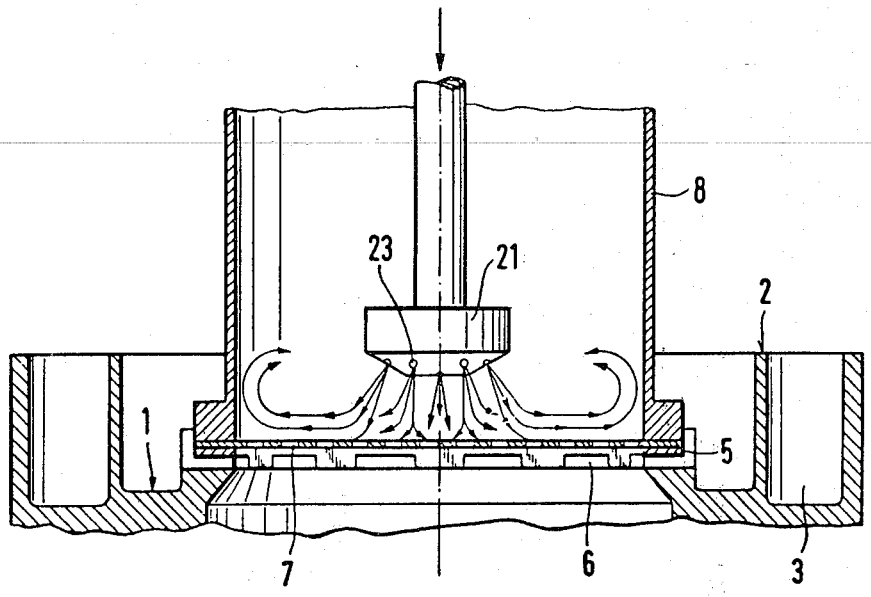
Fig. 2
Fig. 3
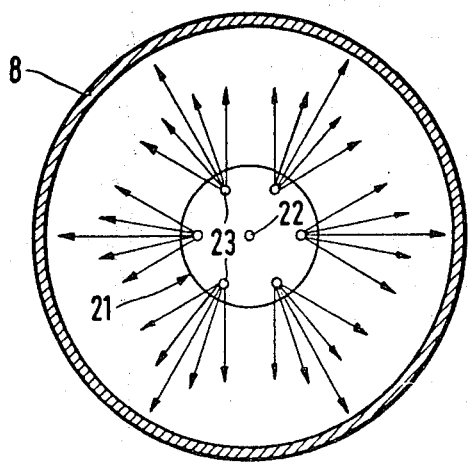

FIBER FRACTIONATING DEVICE

TECHNICAL FIELD

The invention relates to a fiber fractionating device which is intended preferably as a testing device for the determination of the content of coarse particles such as chips or the like in wood fiber materials. This concerns a device which consists of an essentially cylindrical water storage tank open at the top, having an overflow edge, an overflow channel surrounding said overflow edge with an outlet and a closable drain orifice that connects the water storage tank with the overflow channel and the outflow, respectively, an interchangeable fractionating bottom, which is designed as a slotted plate, sieve or the like and rests inside the water storage tank on a support above the bottom of the water storage tank that is essentially annular and provided with communicating water passage orifices, a cylindrical fractionating vessel which, by means of detachable fastenings is put sealingly on the edge of the fractionating bottom and is tightened against the annular support, a flexible membrane which is clamped into an opening in the bottom of the water storage tank within the annular support and has a rigid center piece that is provided on its bottom side with a periodically pulsatable lift drive, as well as a controllable water feed having water outlet nozzles within the fractionating vessel.

STATE OF TECHNIQUE

The fiber materials, which are obtained especially from wood, for the industry producing paper, pasteboard, cardboard and related products, consist generally of a mixture of fibers having different lengths that have a certain fiber length distribution and, beyond that, contain frequently coarse components of the initial raw material, which have not yet been sufficiently broken up, as well as other possible impurifications. For the supervision of the manufacturing process it is necessary in many cases to know the content of undesirable coarse components and impurifications in a fiber material but possibly also its fiber length distribution. In order to determine these characteristics, so-called fractionating devices are used as test apparatus. The test apparatus known for this purpose use differently graduated slotted plates and sieves by means of which a sample of the fiber material distributed in a watery suspension is separated each time into a sieve passing substance and a sieve residue.

The mechanical wood pulps and wood materials obtained from the wood by means of mechanical break-up methods contain, besides fibrous cells of the wood separated by the break-up process, also cohesive fiber groups, so-called chips which, for instance, are of extreme disadvantage in paper production and for the properties of the paper. Since these chips must be eliminated and repulped the determination of the chip content of mechanical wood pulp and wood materials is of special importance especially for the production of printing papers. On the other hand, the determination of the chip content by means of fractionating laboratory apparatus offers special difficulties in contrast to a length fractionation of the more elastic individual fibers for which partly the same devices are used.

Since the length-related fractionating of fiber material suspensions has been satisfactorily solved to a considerable degree by laboratory means, the present invention relates mainly to the development of a fractionating laboratory device which is supposed to furnish satisfactory results for the determination of the chip content of wood pulp suspensions. By the interchange of appropriate sieves it is then mostly possible to use the same device successfully also for the length-related fiber fractionation.

Since for the determination of the chip content the thickness of the chips is more important than their length, sieves as they are used for length-related fiber fractionating are generally not used for the determination of the chip content but rather slotted plates which are made as precise as possible and whose slot width determines the smallest diameter of the chips to be separated.

The well-known fiber fractionating laboratory devices can principally be subdivided into two types, namely into those where the slotted plates, sieves or the like, which are summarizingly defined as fractionating bottoms in the following, are arranged vertical and those in which the fractionating bottoms are arranged horizontal. The vertical arrangement is preferred here for step fractionating devices where a single sample is separated into different desired fractions while passing through several graduated fractionating bottoms.

Well-known step fractionating devices with vertical fractionating bottoms are the so-called Clark Fiber Fractionating Device and the McNett Fiber Fractionating Device which, for instance, has been accepted in the standard testing methods of the Scandinavian paper industry (see Scan Test M6:69, Svensk Papperstidning 72 (1969), p. 312–314). It is true, the mentioned devices are to be preferred from the viewpoint that, by means of them, the simultaneous separation of a sample into several fractions is possible, however, because of the vertical arrangement of the fractionating bottoms they are unsuited for the determination of the chip content by means of slotted plates as experience has shown. For the determination of the chip content by means of slotted plates there are therefore considered only fractionating devices having a horizontal fractionating bottom. As well-known devices there are to be mentioned here only the Somerville fractionating device and the Brecht-Holl device which is used as a testing apparatus within the framework of the testing of wood pulp according to "Zellcheming-Merkblatt" VI/I/66 (see "Das Papier" (The Paper) 20 (1966), H.5. p. 256–265). Both devices were developed as early as in the thirties. Even if the Somerville device in England and the Brecht-Holl device in the German speaking area are widely used for the determination of the chip content, both devices are connected with considerable disadvantages with respect to the accuracy of measurement and in other respects and therefore they have not yet found acceptance in national testing standards.

Aside from the problems which partly still exist and concern the reproducibility of suitable slotted plates, the Brecht-Holl device has just with respect to inflow technique considerable disadvantages which bring about that the sample put on the fractionating bottom cannot be completely washed out even with relatively long testing times and therefore fiber material remains on the slotted plate together with the chips which are to be retained. The Brecht-Holl device uses water nozzles which are disposed immediately above the fractionating bottom on the inside circumference of the fractionating vessel and, with an essentially tangential component, are directed horizontally into the washing chamber. Furthermore, a vertical deviating plate or baffle plate protrudes from the cylindrical outside wall of the fractionating vessel radially into the washing chamber. Especially the latter measure, which was apparently provided for guiding the washing water circulating through the tangential nozzles into the center of the washing chamber causes dead corners in the flow which can lead to the agglomeration of fibers which remain practically stationary on the fractionating bottom and cannot be destroyed not even by extended washing. These difficulties had brought about before that the testing regulation to be applied had to be restricted to the charge of a sample of 2 g of fiber material (see "Das Papier" 13(1959, p. 372). A sample of only 2 g fiber material, however, is generally to small to get reproducible results. Such a small sample quantity is not sufficient especially if one intends to feed the material which passes through the slotted plate and accumulates in the drain of the chip testing device, directly to the step fractionating apparatus. Moreover, the unfavorable flow conditions in connection with the Brecht-Holl device exclude the use of slot widths less than 0.2 mm which, however with today's quality requirements, becomes widely necessary for the determination of finest chips. Also for certain wood pulps of a more recent type with a very high content of long fibers, such as possibly thermomechanical wood pump, a determination of the chip content is hardly possible with the Brecht-Holl device.

Further disadvantages of the Brecht-Holl device consist thereof that, with respect to its construction, it is not provided for being connected before a step fractionating device since the material passing through the fractionating bottom cannot be guided on into a connected testing apparatus. For this purpose it is essentially decisive that the water-filled spaces of the device outside the fractionating vessel are not designed flow-flavorable and are provided with different obstructive components. Especially disturbing are the hinge holding and closing mechanism for the fractionating vessel, which are below the water level, as well as the non-smooth finish of the center piece within the membrane. Furthermore, the water storage tank below the fractionating bottom cannot be emptied completely.

The Somerville device has essentially similar disadvantages. On this device, too, the water nozzles are disposed horizontally above the fractionating bottom. Because the fractionating bottom has a larger area, the test results with the Somerville device are frequently somewhat more satisfactory than with the Brecht-Holl device since the larger fractionating bottom allows the charge of a larger sample quantity, however, the large fractionating bottom causes other disadvantages. Thus there is disposed below the fractionating bottom an additional perforated support plate in which fibers catch easily so that their quantitative transferring into an after-connected device is not possible. Furthermore, the device is very clumsy because of its large construction size and therefore could not find general acceptance. Thus a relatively large catching vessel is needed, for instance, just in order to rinse off the retained chips from the slotted plate.

DESCRIPTION OF THE INVENTION

Starting from a state of technique as it is represented by the Brecht-Holl device, the invention is based on the problem to develop further a device having the characteristics described in the beginning in such a way that under justifiable test conditions an improved washing out and thereby a stricter separation of the retained portion of chips from the fibers passing through is possible so that even with sample charge quantities of at least 10 g fiber material, reproducible test results are obtained, that the slot width of 0.2 mm common up to now can be reduced to 0.15 mm, if necessary, and that also long fiber materials can be processed which could not be tested before in the Brecht-Holl device. Furthermore, it is the problem of the present invention to design the device here in such a way that for the direct connection of a step fractionating device for the simultaneous determination of the fiber length distribution there is possible a quantitative transfer of the material, that went through the fractionating bottom, into the connected device.

For a device of the type described in the beginning this problem is solved, as defined in the invention, by the fact that the water outlet nozzles are directed essentially from above or slanting from above into the fractionating vessel and that their orifices are arranged on and/or below the level of the overflow edge, the means for detachable fastening of the fractionating vessel are disposed above the overflow edge on the fractionating vessel, the water storage tank and the fractionating vessel—aside from the annular support for the fractionating bottom—have only smooth walls and are without components, protrusions and edges which would hinder the flow and favor the depositing of fibers, and two closable discharge orifices are provided—one of them on the lowest spot of the outer annular space of the water storage tank limited by the annular support and the other one at the lowest spot in the zone of the flexible membrane within the annular support.

In contrast to years of testing practice whose methods have become the point of attack of repeated criticism which, however, up to now did not lead to any radical improvements, there could be surprisingly established in rather long investigations that the wash-out effect of a sample of fiber material can be improved quite considerably in a testing device of the type mentioned in the beginning if, in spite of the use of a slotted plate as the fractionating bottom, the water jets produced by means of water outlet nozzles are guided essentially from the top or slanting from the top into the fractionating vessel. However, also with this direction of the water jets it has proved expedient to arrange the orifices of the water outlet nozzles within the water storage ("dam-up") in the fractionating vessel. Since the water storage in the device is essentially determined by the level of the overflow edge of the water storage tank, the outlet nozzles should not be arranged higher than the overflow edge of the water storage tank. Since, however, because of the resistance to flow of the fractionating bottom the washing water led into the fractionating vessel frequently forms a somewhat higher storage level than it would be corresponding to the height of the overflow edge, slight deviations from the demanded highest arrangement of the water outlet nozzles are harmless as long as the orifices of the nozzles are immersed in the originating water storage during the operation of the device.

It has proved expedient to arrange several water outlet nozzles bundle-like in a common nozzle head in the center of the fractionating vessel. In a preferred embodiment, said bundle-type nozzle head has a water outlet nozzle directed vertically downward and surrounding it a ring of 6 more water outlet nozzles arranged at a uniform distance from one another which are directed slanting outward at a certain angle with the vertical. It proved to be expedient here to use water outlet nozzles which send out a fan-like and/or twisted water jet. The number and the passing material of the individual water outlet nozzles, however, have to be set up individually in such a way that, with the commonly used pressure of the water network, allow the water quantity required per unit of time according to the testing conditions developed for the device to flow out while showing a jet intensity necessary for a sufficient turning over of the water volume present in the fractionating vessel. Here the effect of the water jets can be optimized if in proportion to the level of the stored water above the fractionating bottom and to the diameter of the fractionating vessel a certain angular position of the water outlet nozzles directed downward is maintained. Special conditions for that are claimed in the sub-claims and explained in detail in the following description of the drawing.

By the attachment of the detachable fastening means on the fractionating vessel above the level of the overflow edge there is achieved that the fractionating vessel within the stored water rests merely by a smooth edge, if necessary, with insertion of a likewise smooth sealing ring, on the edge of the fractionating bottom and together with it can be pressed uniformly sealing against the annular support within the water storage tank. Hereby there are avoided any components below the water level which have generally an irregular shape as the attaching of, for instance, hinges and closure means at the lower part of the fractionating vessel would necessitate. By the absence of additional components and by the essentially rotary-symmetrical design of all parts of the vessel, optimal flow conditions are obtained. In this manner there can form also a pulsating flow, which is distributed over the entire circumference of the membrane in the bottom of the water storage tank. This flow runs in a radial direction from the washing chamber within the fractionating vessel, through the fractionating bottom, over the annular surface of the membrane through the communicating orifices in the annular support into the outer annular space of the water storage tank, and partly returns in the same direction as far as the pulsating flow exceeds the water feed. This more uniform form of the flow conditions, too, leads to a better separating washing of the fiber material sample and thus to more accurate test results.

The providing of rotary-symmetrical smooth spaces guarantees simultaneously that no fibers can deposit within the device and that the entire material passing through the fractionating bottom can be transferred to an after-connected device. In order to be able to drain the device also quantitatively into the following device after the completion of the washing operation, there is provided in the membrane space below the fractionating bottom at the lowest point of the usual bend of the membrane an additional draining orifice which is in connection with the drain of the device by means of a closable valve.

Although the device as defined in the invention can be used—even after exchanging the slotted plate for suitable sieves—easily for the separation of a sample into two fractions having different fiber lengths, it is a special characteristic of the device that, because of the design as defined in the invention, it can be directly connected before a step fractionating device, preferably a device of the McNett construction type. The use of the present device in this combination is therefore also supposed to be placed under protection. As it will become evident from the following description of the best embodiment, the device as defined in the invention is preferably designed in such a way that the operating conditions are adjusted to those of a McNett device.

By means of the device as defined in the invention there can be easily determined—besides on convential mechanical wood pulp—also the chip content of cellulose and of especially long-fiber, for instance, thermomechanical wood pulp, also on a sample size of about 10 g fiber material as the test results have shown. The excellent washing effect leads to the fact that there remain on the slotted plate only pure chips which, after the have been rinsed off the fractionating bottom and after they have been sucked off, are easily available to enlargement and projection on a membrane filter and, in the enlarged illustration can themselves be easily separated into different size classes by suitable counting and measuring methods.

A further application of the device as defined in the invention seems to open up for a simple determination of resin particles and dirt particles in chemically decomposed cellulose whose elastic, relatively long individual fibers could not be handled by the Brecht-Holl device up to now.

In the following, the fractionating device as defined in the invention will be described in detail in its preferred type with reference to the attached drawings.

SHORT DESCRIPTION OF THE DRAWINGS

FIG. 2 shows a section from FIG. 1 in which the flow course of the water jets coming out of the water outlet nozzle is shown schematically;

FIG. 3 shows a schematic illustration of the direction of flow from the nozzle, seen from above.

DESCRIPTION OF THE BEST EMBODIMENT OF THE INVENTION

Figure 1:
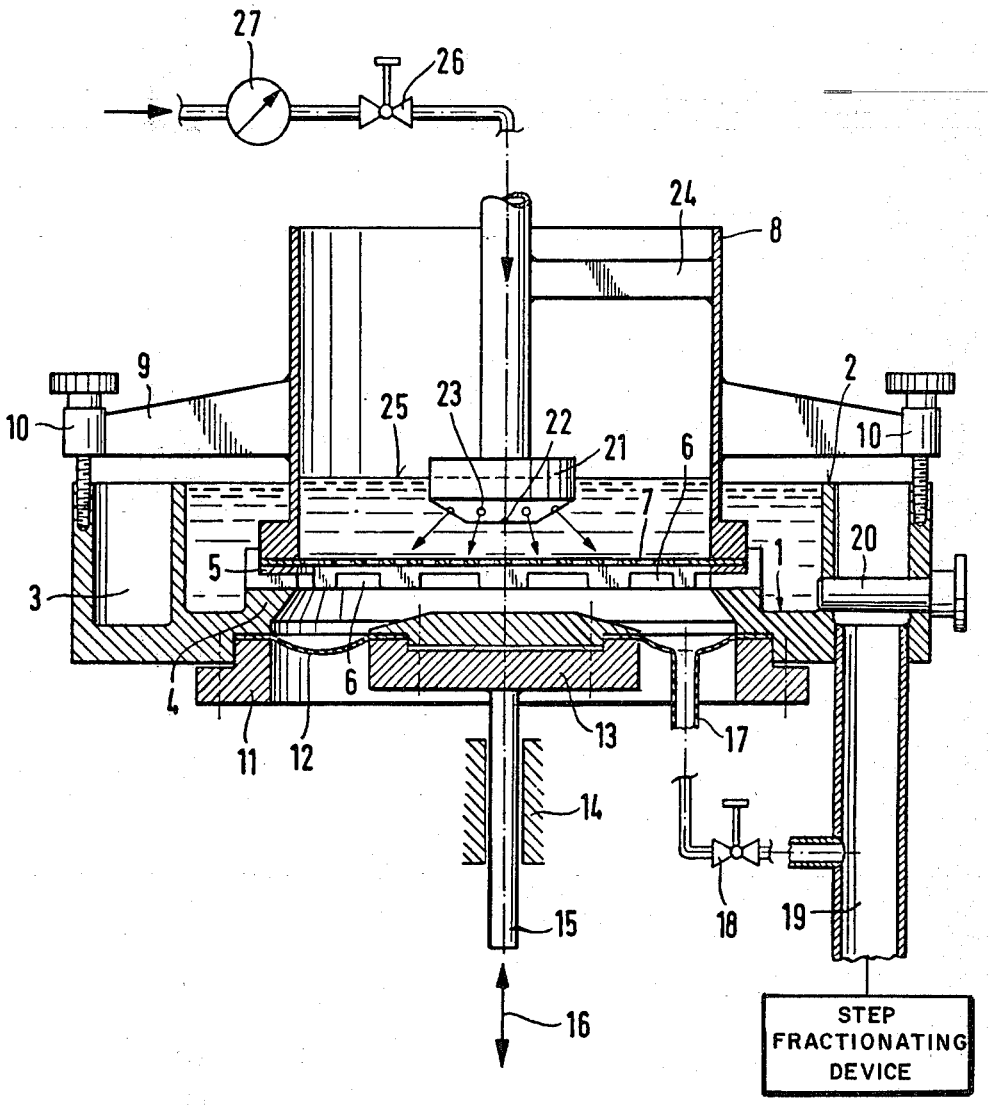
FIG. 1 shows a schematic cut through the best, established embodiment of the fractionating device as defined in the invention.

The fiber fractionating device shown schematically in a cut in FIG. 1 consists of a round water storage tank (1) which is provided with a surrounding overflow edge (2). Outside the overflow edge (2), the water storage tank (1) is furthermore surrounded by the overflow channel (3) going around which is made one-piece with the tank. Within the water storage tank (1) there is provided an annular collar (4) which together with the ring (5), which is put on and provided with perforations (6) for a communicating water flow, forms the annular support for the fractionating bottom (7) which in the present case is designed as a slotted metal plate. On the edge of the fractionating bottom (7) there is placed the lower edge of a fractionating vessel (8) which on its outside above the overflow edge (2) of the water storage tank (1) is provided with three radial arms (9) which are disposed at angles of 180° on the outside of said vessel and carry on their ends fastening devices (10) in form of bajonet locks whose stationary opposite parts are fastened on the upper edge of the outside wall of the overflow channel (3). By means of the bajonet locks (10), the fractionating vessel (8) can, with an annular packing put in between, be pressed sealingly against the edge of the fractionating bottom (7) and by way of it against the ring (5) of the annular support in the water storage tank (1). In order to remove the fractionating vessel (8) this type of fastening is easily accessible from above and easily handled and permits the entire circumference of the fractionating vessel (8) to be pressed uniformly sealing onto its support. By the arrangement of the arms (8) and the bajonet lock (10) above the overflow edge (1), the water-filled space of the device is kept free of components obstructing the flow.

An annular rubber membrane (12) is clamped by means of a clamping ring (11) into an opening provided in the bottom of the water storage tank (1) within the annular collar (4). The inside edge of the rubber membrane (12) is clamped between the disks of a flat plunger (13) which on its bottom side is connected with a push rod (15) which is guided in the device frame (14) and on which, indicated by the reference number (16), a periodically pulsating lift drive attacks. It is essential that the inside surface of the rubber membrane passes over largely without break into the flat plunger (13) and that its upper plate with respect to flow technique is made smooth on its outside surface facing the water storage tank and has no protruding screwheads, slots provided with edges or the like. On its lowest curved spot, the rubber membrane (12) is provided with a discharge connection piece (17) which, by way of a line closable by a valve (18) is connected with the main drain (19) of the device and is connected to the bottom side of the overflow channel (3). Within the drain (19) there is also a closable discharge orifice (20) which connects the water storage tank (1) at its lowest spot outside the annular collar (4) with the overflow channel (3).

Within the fractionating vessel (8) there is disposed a nozzle head (21) having several water outlet nozzles (22, 23) which, by means of a holder (24) is fastened on the inside wall of the fractionating vessel (8) in the zone of its upper edge. The nozzle head (21) is disposed in the center of the fractionating vessel (8) in such a way that the orifices of the water outlet nozzles (22 and 23) are located below the overflow edge (2) or below the water level (25), respectively, in the fractionating vessel. The nozzle head (21) is provided with a center outlet nozzle (22) pointing vertically downward and with a ring of six more water outlet nozzles (23) directed outward the orifices of which are all located below the overflow (2) and the water level (25) dammed up by it.

The water feed of the nozzle head (21) is provided with a control valve (26) and a corresponding control and measuring device (27). For the control of the water feed there is essentially important—besides the maintaining of a suitable pressure—that the water quantity flowing out per unit of time can be accurately adjusted and kept constant.

FIGS. 2 and 3 illustrate the flow picture resulting from the water outlet nozzles used. The slanting position of the outer nozzles (23) is dependent on their distance from the center axis of the fractionating vessel (8), on their height above the fractionating bottom (7) and on the diameter of the fractionating bottom. The nozzles are supposed to be directed approximately in such a way that the extension of their center jets hit the fractionating bottom (7) in the zone of the center third of its radius. However, this statement can serve only as a guiding value; the optimal flow conditions can be determined without difficulty by tests in the individual case according to the type and the position of the water outlet nozzles used. It is especially expedient to use nozzles with a jet fanned out conically which, in addition, is twisted in itself. By this arrangement there is achieved that the fiber material to be fractionated is separated into individual fibers and that the flow, which brings this about, reaches all areas above the fractionating bottom with a suitable angle of flow. Thereby flocculation within the fiber material suspension is avoided and the fractionating performance through the slotted plate is considerably improved. This is true with respect to the sieved fiber quantity as well as to the obtained separating effect.

On the illustrated preferred embodiment of the fractionating device as defined in the invention, the diameter of the slotted plate used of 170 mm corresponds to that of the Brecht-Holl device. The storage level of the overflow edge (2) above the surface of the slotted plate is 45 mm. This storage level of the overflow edge (2), which has been increased by 25 mm compared to the Brecht-Holl device, is also favrorable for the wash-out effect.

With the used diameter of the slotted plate of 170 mm, a storage level of 45 mm and a water feed quantity of about 10 l/m, the best results were obtained by the use of a bundle nozzle, make Lechler, Type B 172.5, which is arranged in such a way that the orifices of its nozzle ring are located about 15 to 20 mm above the slotted plate and therefore dip into the stored water about 25–30 mm.

The bundle-type nozzle of the mentioned type has a vertical nozzle and arranged around it a ring of 6 nozzles which are arranged at a distance of about 26 mm from the center nozzle at an angle of about 30° to 35° to the vertical and are directed outward. The jets of the individual nozzles have the form of hollow cones having aperture angles of about 90°—with the liquid being simultaneously put into rotary motion. The spraying angle of the entire nozzle head is between 120° and 140°.

The nozzle holes have a diameter of 2.5 mm so that with a water pressure between 2 and 3 bar a total outflow quantity of the nozzle head of 10 l/m results. The accurate outflow quantity of the device can be adjusted by a control of the water pressure.

The pulsation drive (16) of the device leads to 200 up and down strokes of 18 mm per minute.

The following test conditions have proved to be favorable in connection with the use of a conventional slotted plate having a slot width of 0.2 mm.

| | | |
|---|---|---|
| charge quantity (g fiber material imagined absolutely dry) | 10 | 20 |
| charge volume (l) | 2 | 4 |
| charge duration (min) | 2 | 5 |
| water quantity (l/min) | 10 | 10 |
| total washing time (min) | 20 | 40 |

COMMERCIAL UTILIZATION

The enclosed table shows the results of comparative measurings on three different wood fiber materials between the device as defined in the invention and the Brecht-Holl device. On the Brecht-Holl device there was used a fiber material charge of 2 g and on the device as defined in the invention a charge of 10 g according to the test conditions mentioned above. The results show not only the considerably less dispersion of the obtained chip contents when measured with the device as defined in the invention but beyond that also absolutely lower values when measured with the device as defined in the invention—a fact which can be traced back to the improved washing effect and thereby sharper separating effect compared to the conventional Brecht-Holl device.

The stated test conditions for the described embodiment of the fractionating device as defined in the invention have been selected in such a way that a step fractionating device of the McNett type can be connected easily. For that device, too, a sample quantity of 10 g and a water charge of 10 l/min is prescribed. By the combination of the two types of devices there can be determined in a single operation the chip content of a fiber material and also a multi-step fiber length fractionation can be obtained.

| Type of material | grinding degree (°SR)(+) | Brecht-Holl device with a charge of 2 g | | device as defined in the invention with a charge of 10 g | |
|---|---|---|---|---|---|
| | | % chips | variation coefficient(o) | % chips | variation coefficient(o) |
| mechanical wood pulp non-hydrated | 63 | 0.78 | 12.8 | 0.41 | 4.9 |
| mechanical wood pulp hydrated | 70 | 0.33 | 21.2 | 0.20 | 4.9 |
| thermomechanical wood pulp | 68 | 0.30 | 26.7 | 0.07 | 11.8 |

(+)°SR = degrees Schopper-Riegler (dehydration capability)
(o)variation coefficient is based on 10 individual measurings

I claim:

1. In a fiber fractionating device, preferably for the determination of the content of coarse particles, such as chips or the like, in wood fiber materials, said device consisting of an essentially cylindrical water storage tank (1) open at the top, having an overflow edge (2), and overflow channel (3) surrounding said overflow edge (2) with an outlet (19) surrounding said overflow edge (2) and a closable drain orifice (20) that connects the water storage tank (1) with the overflow channel (3) and the outflow (19), respectively, an interchangeable fractionating bottom (7), which is designed as a slotted plate, sieve or the like and rests inside the water storage tank (1) on a support (4, 5) above the bottom of the water storage tank (1) that is essentially annular and provided with communicating water passage orifices (6), a cylindrical fractionating vessel (8) which, by means of detachable fastenings (10) is put sealingly on the edge of the fractionating bottom (7) and is tightened against the annular support (4, 5), a flexible membrane (12) which is clamped into an opening in the bottom of the water storage tank (1) within the annular support (4, 5) and has a rigid center piece (13) that is provided on its bottom side with a periodically pulsatable lift drive (16), as well as a controllable water feed (21, 26, 27) having water outlet nozzles (22, 23) within the fractionating vessel (8), the improvement comprising the water outlet nozzles (22, 23) are directed essentially from above or slanting from above into the fractionating vessel (8) and that their orifices are arranged on and/or below the level of the overflow edge (2), the means (9, 10) for the detachable fastening of the fractionating vessel (8) are disposed above the overflow edge (2) on the fractionating vessel (8), the water storage tank (1) and the fractionating vessel (8)—aside from the annular support (4, 5)—have only smooth walls and are without components, protrusions and edges which would hinder the flow and favor the deposit of fibers, and two closable discharge orifices (17, 20) are provided—one of them at the lowest spot of the outer annular space of the water storage tank (1) limited by the annular support (4, 5) and the other one at the lowest spot in the zone of the flexible membrane (12) within the annular support (4, 5).

2. Fiber fractionating device as claimed in claim 1, in which the water outlet nozzles (22, 23) are designed in such a way that they give off a water jet which is fanned out at about an angle of opening of 90° and/or is twisted in itself.

3. Fiber fractionating device as claimed in claim 1, in which the water outlet nozzles (22, 23) are combined in a bundle-type nozzle head (21) which is preferably held on the wall of the fractionating vessel (8).

4. Fiber fractionating device as claimed in claim 3, in which the bundle type nozzle head (21) has in its center a water outlet nozzle (22) directed downward and around it a ring of six water outlet nozzles (23) directed outward at an angle of about 30° to 35° to the vertical.

5. Fiber fractionating device as claimed in claim 4, in which the storage ("dam-up") height of the overflow edge (2) above the fractionating bottom (7) is 45 mm and the diameter of the fractionating bottom (7) is 170 mm.

6. Fiber fractionating device as claimed in claim 4, in which the water outlet nozzles (23) directed outward are arranged below the overflow edge (2) at a height above the fractionating bottom (7) which corresponds to about one fourth of its distance from the wall of the fractionating vessel (8).

7. Fiber fractionating device as claimed in claim 4, in which the individual water outlet nozzles (22, 23) have a diameter of 2.5 mm and the bundle-type nozzle head (21) has a water outlet quantity of 10 l/min at a pressure between 2 and 3 bar.

8. Fiber fractionating device as claimed in claims 1 or 2, in which these means (9, 10) for the detachable fastening consists of arms (9) which are attached on the outside of the cylindrical jacket of the fractionating vessel (8) and are provided on their ends with closing devices (10) which are connectable with counter-devices that are preferably provided on the outside wall of the overflow channel (3)—with the closing devices being made in such a way that with their help the fractionating vessel (8), with the fractionating bottom (7) put in between, can be pressed uniformly sealing against the annular support (4, 5).

9. A fiber fractionating device as claimed in claim 1 in connection with a step fractionating device.

10. Fiber fractionating device as claimed in claim 1 in which all water-filled spaces are designed symmetrical with respect to rotation.

11. Fiber fractionating device as claimed in claim 1 in which said other draining orifice (17) is arranged in the depression of the annular flexible surface of the flexible membrane (12).

* * * * *